US007596911B2

(12) United States Patent
Turco

(10) Patent No.: US 7,596,911 B2
(45) Date of Patent: Oct. 6, 2009

(54) BUILDING ASSEMBLY COMPONENT

(75) Inventor: Angelo Michael Turco, Bruce (AU)

(73) Assignee: Hiltive Pty Limited, Bruce, Act (AU)

( * ) Notice: Subject to any disclaimer, the term of this patent is extended or adjusted under 35 U.S.C. 154(b) by 306 days.

(21) Appl. No.: 10/589,121

(22) PCT Filed: Feb. 10, 2005

(86) PCT No.: PCT/AU2005/000156

§ 371 (c)(1),
(2), (4) Date: Aug. 11, 2006

(87) PCT Pub. No.: WO2005/078210

PCT Pub. Date: Aug. 25, 2005

(65) Prior Publication Data

US 2007/0151172 A1 Jul. 5, 2007

(30) Foreign Application Priority Data

Feb. 11, 2004 (AU) ..... 2004900632

(51) Int. Cl.
*E04B 1/61* (2006.01)
*E04B 2/00* (2006.01)
*E04B 2/30* (2006.01)
*E04C 1/40* (2006.01)

(52) U.S. Cl. ..... 52/127.6; 52/762; 52/772; 52/483.1; 52/511

(58) Field of Classification Search ..... 52/127.6, 52/762, 772, 483.1, 511
See application file for complete search history.

(56) References Cited

U.S. PATENT DOCUMENTS 3,363,381 A * 1/1968 Forrest ..... 52/464
3,412,515 A * 11/1968 Finon ..... 52/480
3,729,883 A * 5/1973 Thompson ..... 52/481.2

(Continued)

FOREIGN PATENT DOCUMENTS

AU 735352 7/2001

(Continued)

OTHER PUBLICATIONS

International Search Report, together with Written Opinion, corresponding to PCT/AU2005/00156, under date of mailing of Mar. 14, 2005.

*Primary Examiner*—Brian E Glessner
*Assistant Examiner*—Omar Hijaz
(74) *Attorney, Agent, or Firm*—Quarles & Brady LLP

(57) ABSTRACT

A jointing element (40) is disclosed for supporting a plurality of cladding panels (10) relative to a building frame (11), the panels having slots (18) extending along the edges thereof, the jointing element including: an elongate support member (20) substantially H shaped in cross-section and having a longer inner flange for fastening to the building or building frame, the inner flange being connected by a web to a shorter outer flange to form an elongate recess on each side of the web for receiving sealing means (30) therein; whereby when a cladding panel is supported relative to the building or building frame by the jointing element, the outer flange is received in the slot along the edge of the cladding panel and the sealing means cooperates with the panel to substantially seal the space behind the cladding panel against the ingress of moisture.

6 Claims, 3 Drawing Sheets

U.S. PATENT DOCUMENTS 4,506,484 A * 3/1985 Bartlett et al. ..... 52/476
4,516,373 A * 5/1985 Osawa ..... 52/387
5,709,058 A * 1/1998 Shaw ..... 52/404.1
6,170,214 B1 * 1/2001 Treister et al. ..... 52/511
6,289,646 B1 * 9/2001 Watanabe ..... 52/506.01
6,430,883 B1 * 8/2002 Paz et al. ..... 52/235
6,993,875 B2 * 2/2006 Rudduck ..... 52/474
2004/0010998 A1 * 1/2004 Turco ..... 52/762
2005/0097841 A1 * 5/2005 Milligan et al. ..... 52/204.5

FOREIGN PATENT DOCUMENTS

DE 29907385 U1 10/2000
GB 2223787 A * 4/1990

* cited by examiner

BUILDING ASSEMBLY COMPONENT

CROSS-REFERENCE TO RELATED APPLICATIONS

This application claims priority to International Patent Application PCT/AU2005/00156 filed 10 Feb. 2005, which claims priority of AU application 2004900632 filed 11 Feb. 2004.

TECHNICAL FIELD

This invention relates to a building assembly component.

The invention has particular application to a building assembly for and method of fastening cladding panels to buildings or building frames, and to a jointing system for use in such an assembly and method.

BACKGROUND OF INVENTION

A variety of methods and assemblies are known for fastening cladding panels to buildings or building frames. One such method and assembly is described in our International Patent Application PCT/AU01/01119, the description of which is incorporated herein by reference.

For ease of reference the fastening assembly of this earlier application is illustrated in FIG. 1 herein. Elongate jointing elements in the form of a channel 12 having laterally extending flanges 17 are fixed to a building frame 11 by screws 13. Sealing gasket 14 has a pair of ribs 16 extending laterally either side of channel 12 and is fixed between channel 12 and frame 11. A cover strip 15 is fixed to channel 12 to cover channel portion 22. Cladding panels 10 with slots 18 along the edges are retained in position against the building frame with flanges 17 extending into slots 18.

SUMMARY OF INVENTION

The present invention aims to provide an alternative to known building assemblies and methods, and to components for use therein.

In one aspect this invention resides broadly in a jointing system for supporting a plurality of cladding panels relative to a building or building frame, the panels having slots extending along the edges thereof, the jointing system including:— an elongate support member substantially H shaped in cross-section and having a longer inner flange for fastening to the building or building frame, the inner flange being connected by a web to a shorter outer flange to form an elongate recess on each side of the web for receiving sealing means therein;

whereby when a cladding panel is supported relative to the building or building frame by the support member, the outer flange is received in the slot along the edge of the cladding panel and the sealing means cooperates with the panel to substantially seal the space behind the cladding panel against the ingress of moisture.

In one preferred embodiment the sealing means can be an elongate gasket located in each recess. Alternatively, in another preferred embodiment the sealing means can be a beading of sealant inserted into each recess.

In another aspect the invention resides broadly in a method of fastening a plurality of cladding panels to a building or building frame, the panels having slots extending along the edges thereof, the method including:— fastening to the building or building frame a jointing system, the jointing system having an elongate support member substantially H shaped in cross-section and having a longer inner flange for fastening to the building or building frame, the inner flange being connected by a web to a shorter outer flange to form an elongate recess on each side of the web for receiving sealing means therein, and supporting a cladding panel relative to the building or building frame with the outer flange of the elongate support member received in the slot along the edge of the cladding panel and the sealing means cooperating with the panel to substantially seal the space behind the cladding panel against the ingress of moisture.

In one preferred embodiment the method includes inserting a beading of sealant into each recess. Alternatively the sealing means can be an elongate gasket pre-located in each recess.

It is preferred that the support element is an aluminium extrusion.

It is also preferred that the web is substantially centrally disposed and the longer inner flange extends at each side thereof beyond the ends of the shorter outer flange sufficiently to allow screws to be fixed therethrough for fastening the support member to the building or building frame.

It is also preferred that the gasket includes longitudinally extending rib means and a longitudinally extending end portion such that on assembly when the outer flange is received in the slot along the edge of the cladding panel, the rib means resiliently engages the inner surface of the cladding panels and the longitudinally extending end portion resiliently engages the inner edge of the cladding panel adjacent the slot.

It is also preferred that the jointing system includes another elongate support member substantially H shaped in cross-section and having a longer inner flange for fastening to the building or building frame, the inner flange being connected by a web to a shorter outer flange to form an elongate recess on each side of the web for receiving sealing means therein;

wherein the distance between the outer surfaces of the flanges of this other elongate support member is less than the distance between the outer surfaces of the flanges of the elongate support member defined above, such that when the elongate support members orthogonally abut with the outer surface of the longer inner flange of this other elongate support member resting on the inner surface of the longer inner flange of the elongate surface member first defined above, the outer surfaces of the shorter outer flanges are substantially coplanar.

DESCRIPTION OF DRAWINGS

In order that this invention may be more easily understood and put into practical effect, reference will now be made to the accompanying drawings which illustrate a preferred embodiment of the invention, wherein:—

DESCRIPTION OF PREFERRED EMBODIMENT OF INVENTION

Figure 5:
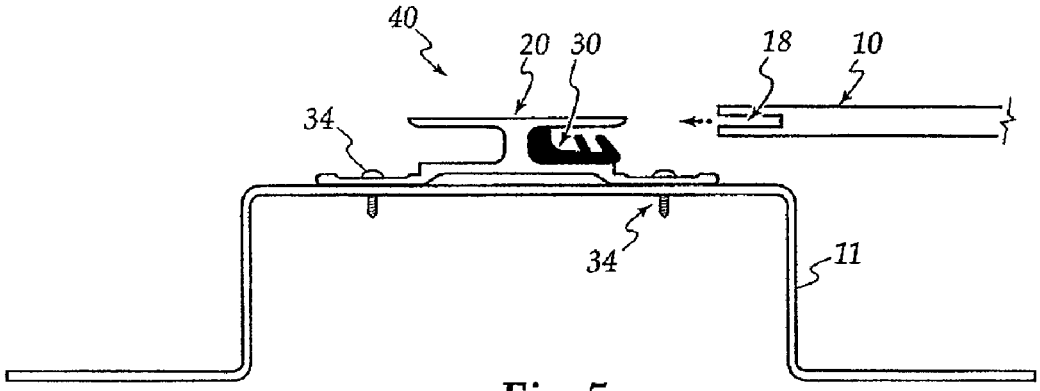
FIG. 5 is a cross-sectional view of the support member of FIG. 2 showing one of the gaskets positioned in a recess, the support member being attached to a building frame, and showing a cladding panel to be assembled.
Figure 6:
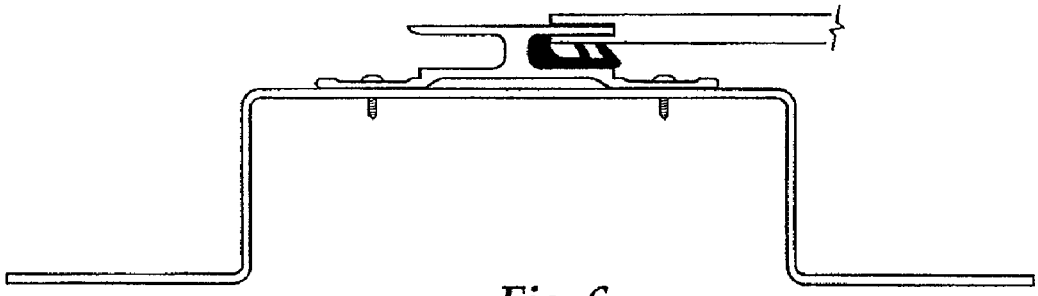
FIG. 6 corresponds with the view of FIG. 5 and shows the cladding panel assembled with the jointing system.

As can best be seen in FIG. 5, the jointing system 40 has an elongate support member 20 in the form of an aluminium extrusion which is substantially H-shaped in cross-section and is fastened along one longer flange to a building frame 11 by screws 34. A pair of elongate gaskets 30 (of which only one is shown in FIG. 5) are positioned in opposite elongate recesses in support member 20. Cladding panel 10 has slots 18 along the edges and as seen in FIG. 6 is supported relative to building frame 11 with the other (outer) flange of support member 20 received in slot 18. The cooperation of the edge of cladding panel 10 with gasket 30 effectively seals the space behind the cladding panel against the ingress of moisture.

Figure 2:
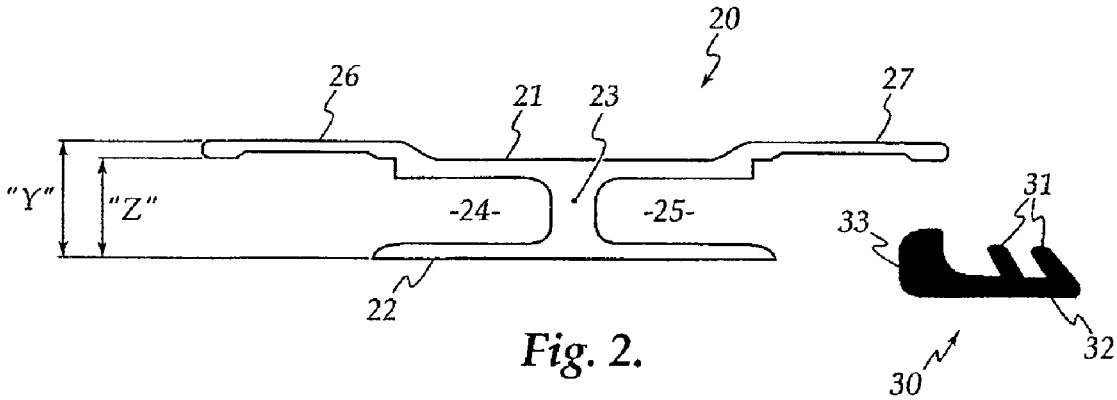
FIG. 2 is a cross-sectional view of a vertical or horizontal support member showing the gaskets removed therefrom.

Turning to FIG. 2 it can be seen that support member 20 is substantially H-shaped in cross-section and has one longer flange 26,21,27 connected to a shorter flange 22 by a central web 23 with a pair of elongate recesses 24 and 25 being formed on opposite sides of web 23. The longer flange has a lower stepped central portion 21 and the sides of the longer flange extend beyond stepped portion 21, and beyond the side edges of shorter flange 22, forming a pair of lands 26 and 27 through which jointing system 40 can be screwed to building frame 11 as previously described.

Figure 3:
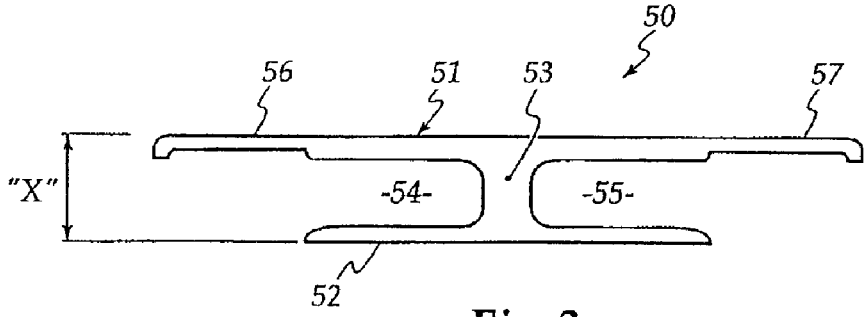
FIG. 3 is a cross-sectional view of a support member for abutting orthogonally against the support member of FIG. 2, showing the gaskets removed therefrom.

Turning to FIG. 3 which shows another support member 50 which abuts orthogonally against support member 20, it can be seen that support member 50 is substantially H-shaped in cross-section and has one longer flange 51 connected to a shorter flange 52 by a central web 53 with a pair of elongate recesses 54 and 55 being formed on opposite sides of web 53. The longer flange 51 does not have a lower stepped central portion. Sides of the longer flange 51 extend beyond the side edges of shorter flange 52, forming a pair of lands 56 and 57 through which jointing system 40 can be screwed to building frame 11 as previously described.

Figure 4:
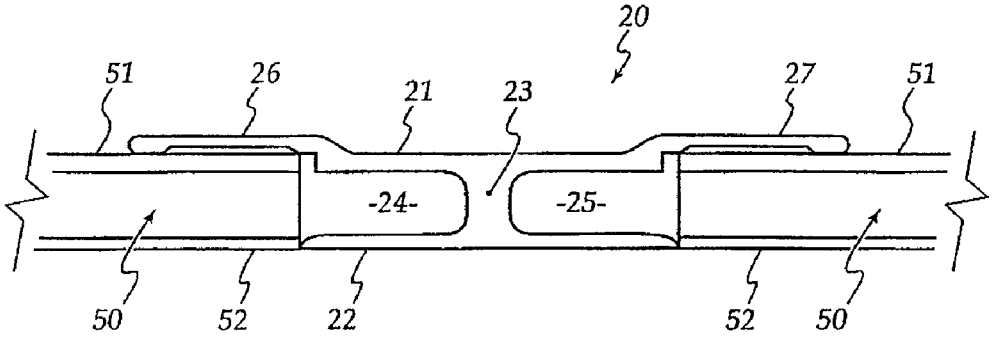
FIG. 4 is a cross-sectional view of the support member of FIG. 2 showing the support member of FIG. 3 orthogonally abutted thereagainst.

The distance between the outer surfaces of the flanges 51 and 52 of support member 50 (dimension "X" in FIG. 3) is less than the distance between the outer surfaces of the flanges 26,27 and 22 of support member 20 (dimension "Y" in FIG. 2), such that when support members 20 and 50 orthogonally abut (as seen in FIG. 4) with the outer surface of inner flange 51 of support member 50 resting on the inner surface of inner flange 26,27 of support member 20, the outer surfaces of the outer flanges 52 and 22 are substantially coplanar. The dimension "X" corresponds with that of dimension "Z" in FIG. 2.

As seen in FIG. 2, elongate gasket 30 is somewhat L-shaped in cross-section with a pair of ribs 31 extending from one arm 32 of the L-section and constituting longitudinally extending rib means, and the other arm 33 of the L-section constituting a longitudinally extending end portion. Gasket 30 is slightly oversize with respect to recesses 24 and 25 and being resilient, forms an interference fit when inserted therein.

As seen in FIG. 6, when cladding panel 10 is fully positioned on jointing system 40, the rib means 31 resiliently engage the inner surface of the cladding panels and the longitudinally extending end portion 33 resiliently engages the inner edge of the cladding panel, thereby effectively sealing the space behind the cladding panel against the ingress of moisture. Cooperation of this inner edge of cladding panel 10 with the resiliently compressible end portion 33 of gasket 30 allows for thermal expansion of the cladding panel due to seasonal temperature fluctuations.

Figure 7A:
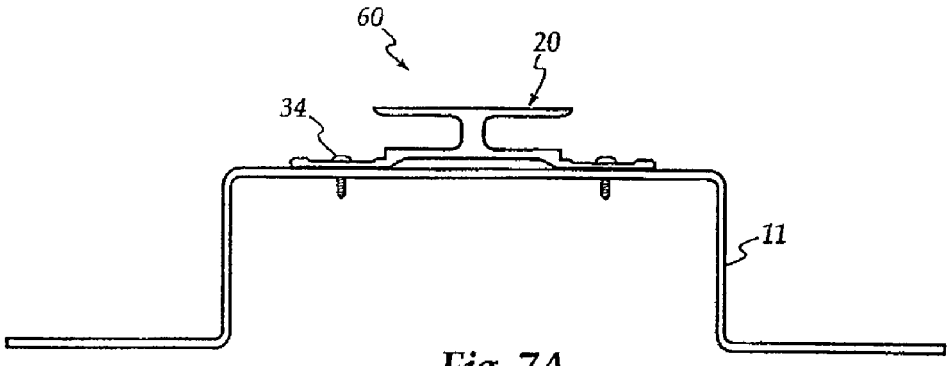
FIGS. 7A to 7D show the method of fastening building panels to a building frame in which a bead of sealant is inserted in the recess in the support member rather than a gasket as illustrated in FIGS. 5 and 6 above.
Figure 7B:
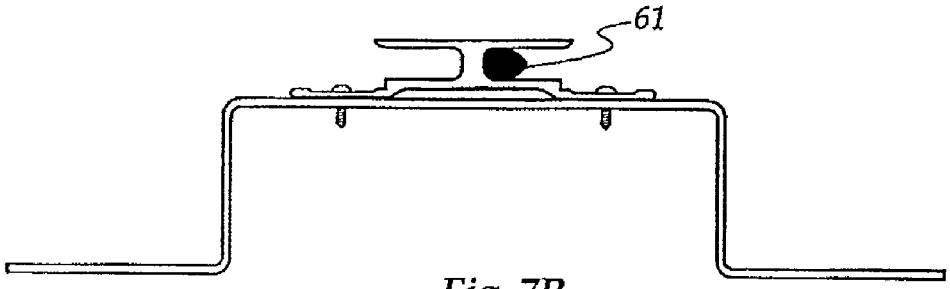
Figure 7C:
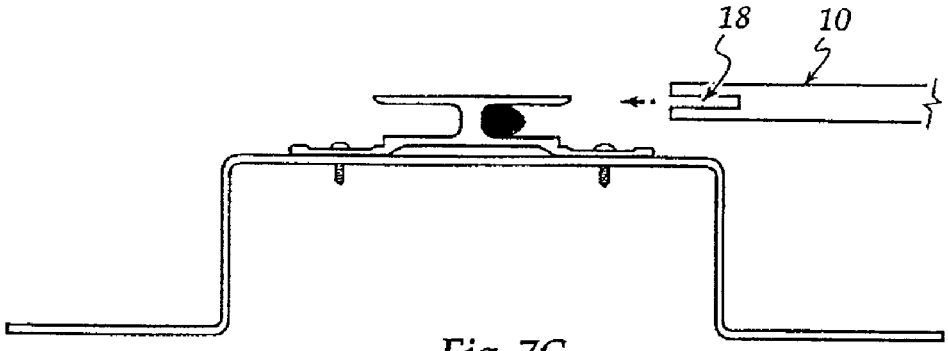
Figure 7D:
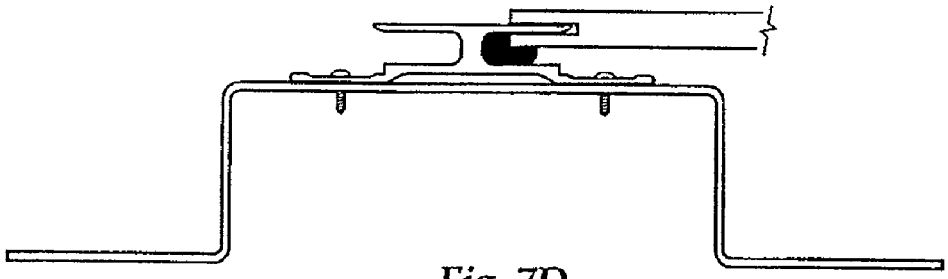

As seen in FIGS. 7A to 7D, rather than the support member 20 being fixed to frame 11 with gaskets in the recesses, it can be fixed to the frame without gaskets, the sealing being effected by running a beading of sealant 61 along the recesses as seen in FIGS. 7B and 7C. This can be done in conventional manner by a sealing gun or the like, or can be jigged for automatic application to ensure quality control. Panel 10 is then fitted onto support member 20 in known manner with the inner edge of groove 18 biting into sealant bead 61 to effect a seal as seen in FIG. 7D.

It will be appreciated that although the preferred embodiments describe fitting the panels and the support members to a building frame, these could also be fixed to a building per se as, for example, when cladding an older building or when fastening cladding to a new building of concrete slab construction or the like. In such cases, the support members can be affixed directly to the building, or as is preferred, bearers of top hat configuration in cross section are fixed to the building. To correct for any surface irregularities in the building, the top hat member is packed out as required to provide an accurate laser surveyed top surface on the top hat members. Support members in accordance with the invention are then fixed to the top hat members and the panels then fitted to the support members in the manner described above.

It will also be appreciated that although the preferred embodiments describe fitting the panels and the support members to the exterior of a building, the invention is equally applicable for fixing panels in interior walling within a building.

The jointing system of the present invention and building systems and methods utilising the system have a number of advantages over known systems.

Figure 1:
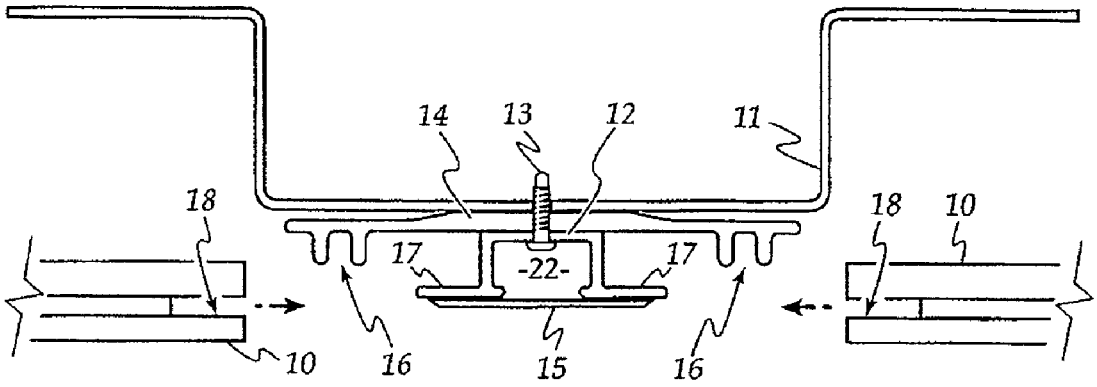
PRIOR ART Fig. 1.
FIG. 1, already described, is a cross-sectional view of a prior art support member attached to a building frame and showing cladding panels to be assembled thereto.

For example in comparison with the product described in FIG. 1, assembly of the various components in the building system is much simpler with a single component jointing system 40) being fastened to the building frame, rather than positioning gasket 14 behind channel 12 which is then fastened to frame 11 and cover strip 15 then fixed over the channel.

Another advantage of the present arrangement is that manufacture of the cladding panel is simplified. Although cladding panel 10 in FIG. 1 is shown with the lips forming slot 18 being of equal length, in practice it has proved necessary to cut back the innermost lip to allow for thermal expansion and avoid buckling of the panel in the event that the inner lip were to engage the wall of channel 12 upon expansion. In the present invention the two lips can remain equal, thereby obviating one operation in manufacture of the panels.

It will of course be realised that whilst the above has been given by way of an illustrative example of this invention, all such and other modifications and variations hereto, as would be apparent to persons skilled in the art, are deemed to fall within the broad scope and ambit of this invention as is herein set forth.

The claims defining the invention are as follows:

1. A jointing system for supporting a plurality of cladding panels relative to a building or building frame, the panels having slots extending along edges thereof, the jointing system including:

first and second elongate support members, each support member having:

a longer inner flange for fastening to the building or building frame, a shorter outer flange, and a web connecting the longer inner flange to the shorter outer flange to form an elongate recess on each side of the web for receiving sealing means therein, the web being substantially centrally disposed relative to side edges of at least one of the longer inner flange and the shorter outer flange such that the elongate support member is substantially H-shaped in cross section; and sealing means received in at least one elongate recess, wherein the distance between the outer surfaces of the flanges of the second elongate support member is less than the distance between outer surfaces of the flanges of the first elongate support member such that when the first and second elongate support members orthogonally abut, with the outer surface of the longer inner flange of the second elongate support member resting on an inner surface of the longer inner flange of the first elongate support member, the outer surfaces of the shorter outer flanges of the first and second elongate support members are substantially coplanar and the outer surface of the longer inner flange of the second elongate support member is offset from the outer surface of the longer inner flange of the first elongate support member by a thickness of the longer inner flange of the first elongate support member; wherein when a cladding panel is supported relative to the building or building frame by the jointing system, at least one outer flange of the first and second elongate support members is received in one of the slots along the edges of the cladding panel; and wherein the sealing means cooperates with the panel to substantially seal a space behind the cladding panel against the ingress of moisture.

2. The jointing system of claim 1, wherein the first elongate support member is an aluminum extrusion.

3. The jointing system of claim 1, wherein the sealing means is a beading of sealant.

4. The jointing system of claim 1, wherein the sealing means is an elongate gasket located in each elongate recess.

5. The jointing system of claim 4, wherein each elongate gasket includes longitudinally extending rib means and a longitudinally extending end portion such that when the outer flange is received in the one of the slots along the edges of the cladding panel, the rib means resiliently engage an inner surface of the cladding panel and the longitudinally extending end portion resiliently engages an inner edge of the cladding panel adjacent the slots.

6. The jointing system of claim 1, wherein the longer inner flange extends at each side thereof beyond the ends of the shorter outer flange sufficiently to allow screws to be fixed therethrough for fastening the support member to the building or building frame.

* * * * *